United States Patent [19]

Salvagnini

[11] 4,385,513

[45] * May 31, 1983

[54] FORMING PRESSES

[75] Inventor: Guido Salvagnini, Arzignano, Italy

[73] Assignee: Salvagnini Transferica S.p.A., Vicenza, Italy

[ * ] Notice: The portion of the term of this patent subsequent to Jan. 6, 1998, has been disclaimed.

[21] Appl. No.: 171,347

[22] Filed: Jul. 23, 1980

[30] Foreign Application Priority Data

Feb. 8, 1980 [IT] Italy ..... 24895 A/79

[51] Int. Cl.[3] ..... B21D 5/04

[52] U.S. Cl. ..... 72/320; 72/306; 72/322

[58] Field of Search ..... 72/306, 323, 321, 322, 72/320, 319, 384, 385, 316, 294

[56] References Cited

U.S. PATENT DOCUMENTS

| | | | |
|---|---|---|---|
| 2,734,552 | 2/1956 | Yonash | 72/384 |
| 3,054,437 | 9/1962 | Laxo | 72/322 |
| 3,058,512 | 10/1962 | Chebuhar et al. | 72/321 |
| 3,301,034 | 1/1967 | Boettcher | 72/321 |
| 3,328,995 | 7/1967 | Rohlfs | 72/297 |
| 4,133,198 | 1/1979 | Huda et al. | 72/322 |
| 4,242,898 | 1/1981 | Salvagnini | 72/307 |

FOREIGN PATENT DOCUMENTS

| | | | |
|---|---|---|---|
| 535751 | 4/1941 | United Kingdom | 72/320 |

OTHER PUBLICATIONS

Bath, Cyril, "Pressless Dies Operate in Sequence", from *American Machinist,* Jun. 16, 1949, p. 85.

*Primary Examiner*—Daniel C. Crane
*Attorney, Agent, or Firm*—Yount & Tarolli

[57] ABSTRACT

Forming press for making perimetral bends on metal sheets or plates comprising a support structure having a C-shaped cross section with horizontal arms, a fixed lower counterblade, and an upper blank counterblade, movable in a vertical direction, a cutter block carriage, movably guided in the vertical direction between the arms of said support structure, an upper bending blade and a lower bending blade mounted on said cutter block carriage and having respective active parts cooperating with said counterblades for the downward and upward bending of the edge of a plate firmly held by the counterblades.

In order to prevent the surfaces of the plates, when particularly treated, e.g. satinized, prepainted or coated with protective layers, from being subjected to laceration, microfissuring or to more or less diffuse cracks during the bending, at least one of the bending blades is adjustably movable toward and away from the counterblades from a prefixed initial variable position, at which a prebending is carried out, to a second variable prefixed position closer to the counterblades at which the bending is completed.

2 Claims, 5 Drawing Figures

9
6
19
34
27a
31
35
2
38
37
39
40
35
11a
11
21
24
25
V
V
IV
IV
9
9

FORMING PRESSES

BACKGROUND OF THE INVENTION

The present invention refers to a forming press especially suitable for effecting perimetral bends on rectangular sheets in order to produce panels with edges bent one or more times on all four sides.

In particular, the forming press according to this invention is of the type essentially comprised of a support structure having a C cross section with horizontal arms, a fixed lower counterblade and an upper blank holder counterblade, movable in the vertical direction, the said counterblade being supported and extending longitudinally with respect to the said support structure, a cutter block carriage movably guided in the vertical direction between the arms of the said support structure, an upper bending blade and a lower bending blade both mounted on the said cutter block and cooperating with the said counterblades for the bending, respectively downward and upward, of the edge of a plate firmly held by the counterblades themselves. Such a forming press comprises the basic component of the machine for the production of plate panels with bent edges, described in the U.S. patent application Ser. No. 941,988, filed on Sept. 13, 1978 in the name of the same applicant now U.S. Pat. No. 4,242,898 and cited here for reference.

Relative to the bending of plates, e.g., the perimetral bending of a plate in order to obtain an appropriate panel with bent edges, there is a recognized technical problem when the plate has one or both of the surfaces treated, e.g., satinized, prepainted, or having any other similar protective coating.

This problem consists in the fact that during the bending process substantial and sudden stresses are generated; they are localized along the line of bending of the plate. Such stresses induce stretching effects in the film-like coating layers and cause a definite weakening of the said layers with the possibility of laceration, microfissuring, more or less substantial and more or less diffuse cracks, but always unacceptable in the finished product. In the case of plates with satinized (or similarly treated) surfaces, the elimination of the satiny appearance of the plate itself is generally observed along the bending line.

A resolution of this problem is particularly desirable in the production of panels destinated, e.g., for the manufacture of metal furniture, refrigerators, washing machines, radiators, convectors, shelving in general, and the like, where the possibility of bending surface-treated plates without incurring the above inconveniences would eliminate a whole series of operations and treatments that have been necessary to date with regard to the finished product and thus would result in substantial production savings.

The main purposes of this invention is to resolve the above technical problem by offering a forming press of the type defined above that would have structural and functional characteristics such that one or more bends could be effected along one or more sides of a rectangular plate having one or both surfaces pretreated, e.g., prepainted or satinized.

SUMMARY OF THE INVENTION

This object and others that will be manifested better in the following description are achieved by a forming press according to the invention, which is characterized in that at least one of the said bending blades is adjustably movable toward and away from the said counterblades from a prefixed initial and variable position in which the respective active portion is spaced away from the counterblades in order to effect a prebending on the said plate, to a second prefixed and variable position in which the said active portion is brought up to the counterblade in order to complete the bending of the plate to the desired value.

In accordance with a preferred embodiment of this invention, at least one of the said bending blades is longitudinally and rotatably mounted on a horizontal pivot supported by the said cutter block carriage and extended longitudinally with respect to the latter and by the fact that it is comprised of thrust elements for moving the said bending blade angularly around the said pivot toward and away from the respective counterblade, as well as positive stop elements adjustably positioned between the said cutter block carriage and the said bending blade in order to restrict in both directions the amplitude of angular displacement of the blade itself.

BRIEF DESCRIPTION OF THE DRAWINGS

Additional characteristics and advantages of the invention will be better illustrated by the description of a preferred embodiment of a forming press according to the invention, rendered in the following with reference to the attached drawings, offered solely for the sake of illustration and non limiting.

DESCRIPTION OF A PREFERRED EMBODIMENT

Figure 1:
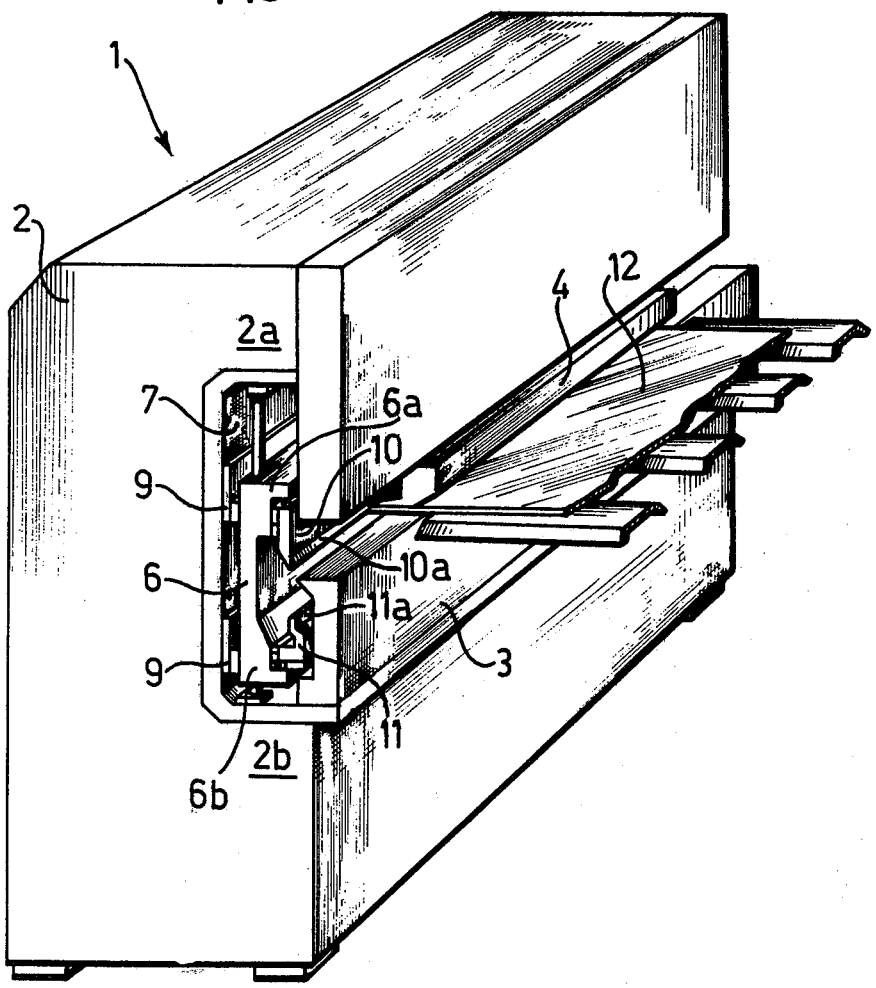
FIG. 1 is a axonometric view of a forming press according to the invention.
Figure 2:
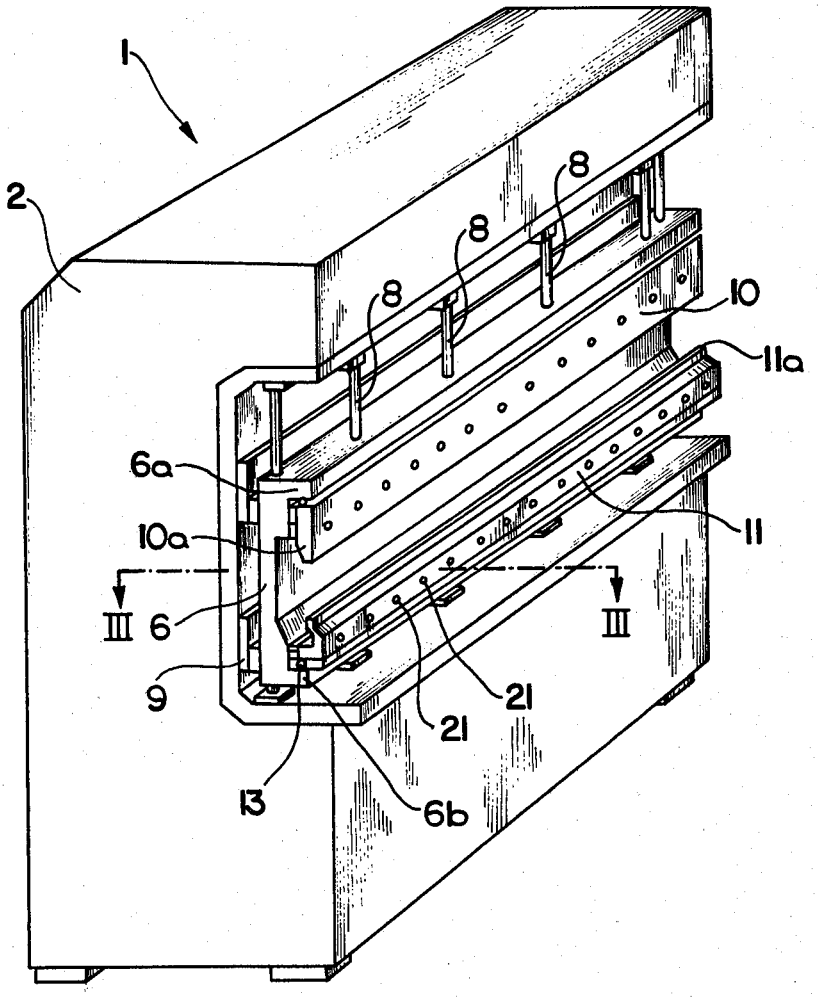
FIG. 2 shows the same press as FIG. 1 in which some details are eliminated for the sake of clarity.

With reference to FIGS. 1 and 2, a forming press is indicated by 1. It is comprised essentially of a support structure 2, having an essentially C-shaped cross section, with parallel upper **2*a* and lower 2*b* arms, a support or counterblade 3, fixed by conventional means (not shown) to the lower arm 2*b* of the support structure, a blank holder counterblade 4, supported by the upper arm 2*a* of the support structure and movably guided in the vertical direction by the actuation of a multiplicity of appropriate means, e.g., consisting of hydraulic cylinders (not shown in that they are conventional ones). The said lower 3 and upper 4 counterblades are extended longitudinally with regard to the support structure 2**.

A rigid cutter block carriage is indicated by 6. It is supported in the opening 7 defined by the arms **2*a* and 2*b* of the support structure and by the counterblades 3 and 4. The cutter block carriage 6 can be moved in the vertical direction by actuating, e.g., the hydraulic cylinders indicated by 8, and is guided in these movements by appropriate vertical slide guides indicated by 9**.

The cutter block carriage 6 has a C-shaped cross section, with upper **6*a* and lower 6*b* arms extending in parallel and in the same direction as the arms 2*a* and 2*b* of the support structure 2**.

Corresponding upper 10 and lower 11 bending blades are connected to the said arms 6a and 6b of the cutter block carriage 6 in a manner that will be described below. The active portions of the said bending blades 10 and 11 are respectively indicated by 10a and 11a. They are designed to cooperate with the counterblades 3 and 4 during the execution of a bend along the edge of a plate 12, solidly held between the said counterblades 3 and 4.

For further structural details of the above components relative to the forming press 1, reference is made to the U.S. patent application Ser. No. 941,988 of the same applicant now U.S. Pat. No. 4,242,898.

Figure 4:
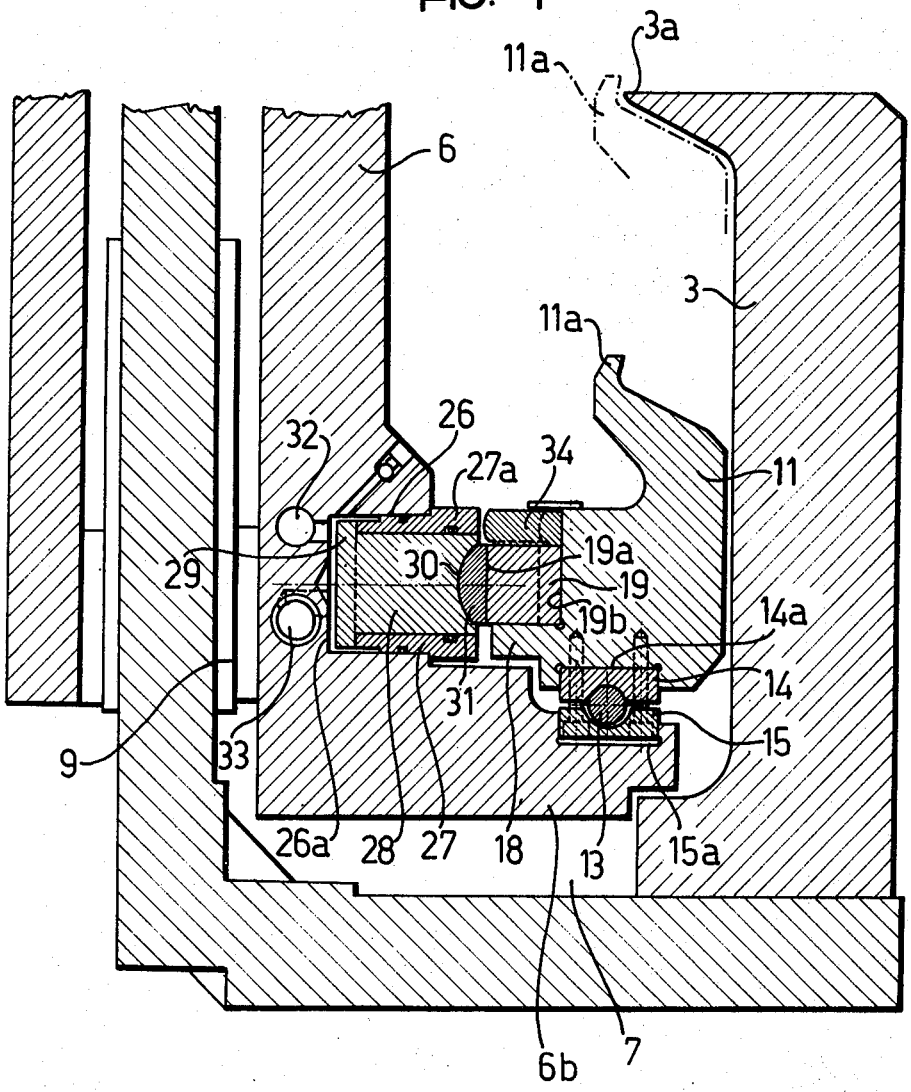
FIG. 4 is an enlarged section along the line IV—IV of FIG. 3.
Figure 5:
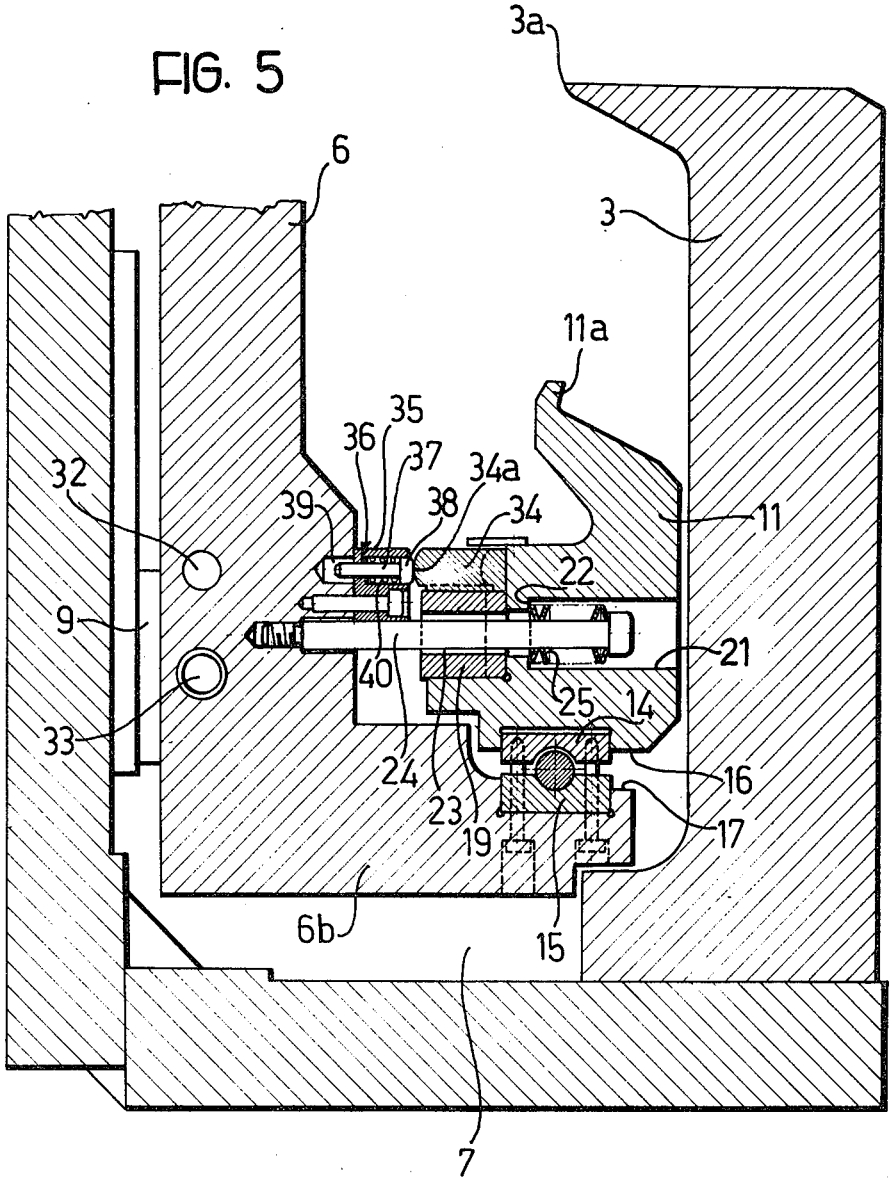
FIG. 5 is an enlarged section along line V—V of FIG. 3.

With reference to FIGS. 4 and 5, the bending blade 11 is longitudinally and rotatably mounted by conventional means on a horizontal journal 13 supported by the lower arm 6b of the cutter block carriage 6 and extending over the entire length of the support structure 2 of the forming press. In particular, the longitudinal axis of the said journal 13 lies in the same vertical plane that contains the corner 3a of the counterblade 3.

According to a preferred design, the bending blade 11 is mounted on the pivot 13 essentially in a pintle-like manner, by means of a multiplicity of block pairs 14 and 15, arranged in the respective seats 14a and 15a, effected longitudinally in the opposite walls 16 and 17 of the bending blade 11 and the lower arm 6b of the cutter block carriage 6. It should be noted that the bending blade 11 is spaced away from the arm 6b of the cutter block carriage by a prefixed distance capable of permitting the desired angular displacements of the blade 11 around the longitudinal axis of the pivot 13.

In the part turned toward the cutter block carriage 6, the bending blade 11 is equipped in its lower portion and longitudinally with a bracket projection 18, on which a sliding bar-shaped wedge 19 is positioned. This bar-shaped wedge has an inclined wall 19a turned toward the cutter block carriage 6 and a vertical wall 19b maintained in sliding contact with the corresponding vertical wall of the bending blade 11. The wedge 19 can be displaced longitudinally and can be adjusted along the bracket projection 18 by actuating conventional means, e.g., by manual or motorized actuation of a corresponding screw 20, accessible on one side of the support structure 2.

The bending blade 11 is transversally traversed by a number of holes 21 (FIG. 5) of prefixed diameter, each of which has an annular shoulder 22. The holes 21 are aligned longitudinally with respect to the blade 11 and are spaced in the said alignment by a prefixed amount. Each hole 21 of the blade 11 is lined up with a corresponding slotted hole 23, passing through the bar-shaped wedge 19. A stud 24 is used in each pair of aligned holes 22 and 23 with a prefixed play and recessed, e.g., screwed into the cutter block carriage 6 and provided with a head 24a positioned inside of the respective hole 22. Between the head 24a of the stud 24 and the annular shoulder 22, a calibrated springed element 25, preferably comprised of a number of cup springs, is positioned in each hole 21. The set of these springed elements 25 forces the blade 11 into an angular position on the pivot 13, spaced away from the cutter block 3.

With reference to FIG. 4, a number of equal cylindrical seats 26, regularly spaced along a longitudinal line with respect to the said cutter block carriage 6, are effected in the cutter block carriage 6 and in the proximity of its lower arm 6b. It should be noted that these cylindrical seats 26 are intercalated with regard to the position of the aligned holes 21–23 cited above.

A cylinder 27, the open end of which inside the said seat is spaced from the bottom 26a of the latter by a prefixed distance, is coaxially fastened in each seat 26.

Outside of the respective seats 26 the cylinders 27 have portions 27a, enlarged, and butting against the internal wall of the cutter block carriage 6. It should be noted that the enlarged portions 27a of the cylinders 27 project out of the respective seats 26 by distances variable from cylinder to cylinder such that the free ends of these cylinders, turned toward the bending blade 11, are essentially aligned along a horizontal straight line parallel to the inclined wall 19a of the bar-shaped wedge 19.

A piston 28 is capable of being displaced in a sealed manner in each cylinder 27. It has an enlarged end portion 29, capable of moving between the bottom 26a of the cylindrical seat 26 and the end of the cylinder 27 inside the seat. At the other end, each piston 28 is coaxially equipped with an essentially hemispheric recess 30, which matches with the essentially hemispheric wall of an insert 31, the other wall of which is flat and is in sliding contact with the inclined wall 19a of the bar-shaped wedge 19.

Pressurized oil collector conduits, respectively feed and drain, are indicated by 32 and 33; they are in liquid communication with each of the above seats 26.

Another bar-shaped wedge 34 having an inclined wall 34a turned toward the cutter block carriage 36 and a flat vertical wall in sliding contact with the vertical wall of the bending blade 11, is positioned on the bar-shaped wedge 19 with sliding contact. This bar-shaped wedge 34 can also be adjustably positioned with regard to the blade 11 by conventional means, accessible on the same side of the support structure 2 as indicated with reference to bar-shaped wedge 19.

The inclined wall 34a of wedge 34 is preferably convex and is in sliding contact with a number of positive stops 35, fixed on the inside wall of the cutter block carriage 6.

Figure 3:
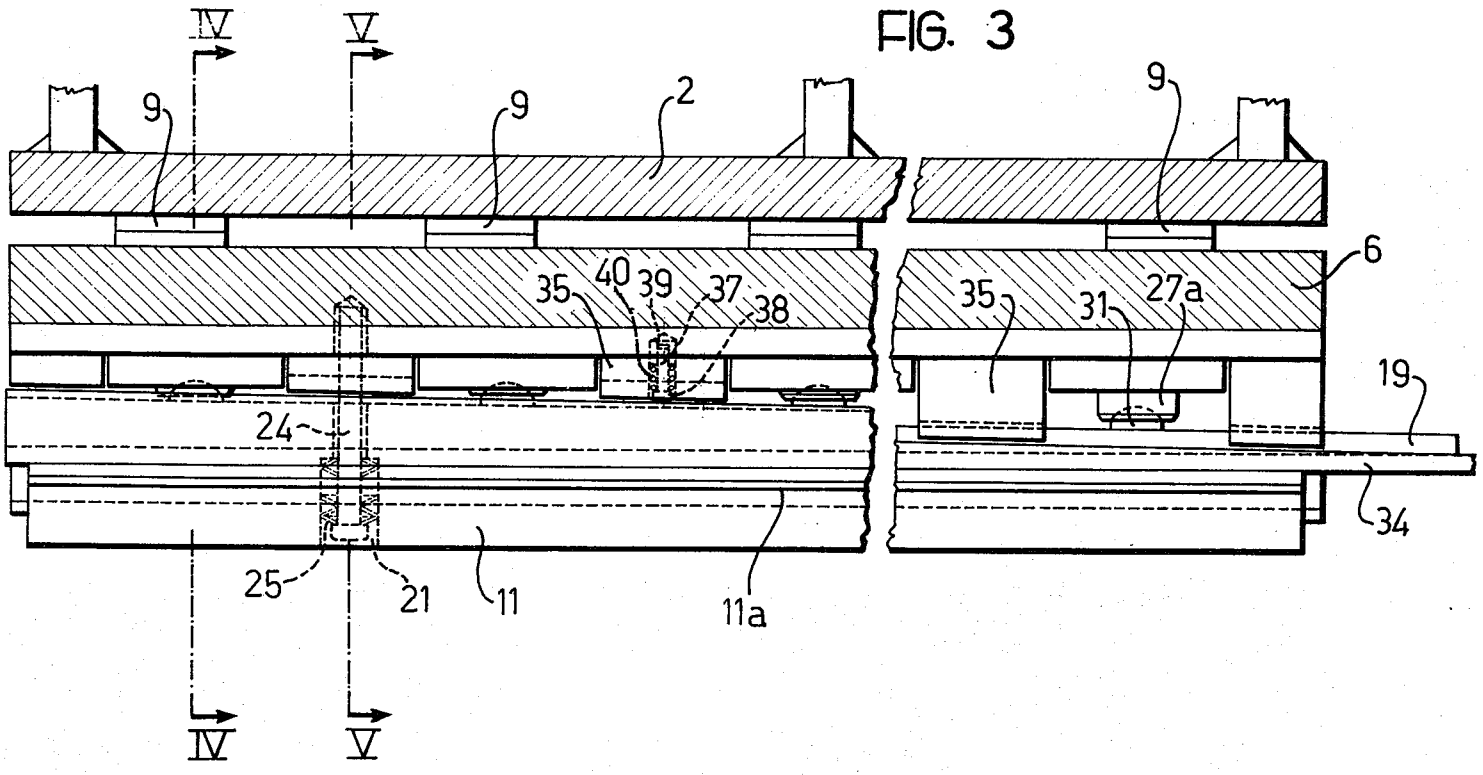
FIG. 3 is a section along the line III—III of FIG. 2.

With reference to FIG. 3, it should be noted that the number of free faces of the said stops 35 lie in a common vertical plane parallel to the inclined side of bar-shaped wedge 34 and that this plane projects by a small prefixed amount beyond the outer profile of the free ends of the enlarged portions 27a of the above cylinders 27. Advantageously, the positive stops 35 are comprised of blocks equipped centrally with an elastic element 36, e.g., comprised of a peg 37, equipped with a head 38 and capable of moving in a seat 39 effected in each block, against a calibrated spring 40.

It is evident from the above description and the figures in the attached drawings, in particular, FIGS. 3, 4, and 5, that the bending blade 11 can be displaced angularly around the longitudinal axis of the pivot 13, in a counterclockwise direction when the action of the set of cup springs 25 is predominant on it and in a clockwise direction when the action of the set of pistons 28 is predominant on it. It is also evident that the angular amplitude of these displacements can be varied at will by shifting the bar-shaped wedges 19 and 34. In particular, by displacing the wedge 34 the "end of travel" positions of the counterclockwise angular displacements of the blade 11 are modified, while the "end of travel" positions of the clockwise angular displacements of the said blade are varied by corresponding displacement of wedge 19.

In order to effect an upward bend along one side of a plate 12, it is initially provided in the development of the bending blade 11 or, more precisely, the preestablishment of the amplitude of angular displacement that this blade is to effect around the axis of pivot 13 is provided.

For this purpose, after having discharged the oil from the cylindrical seats 26, such that only the force resulting from all the cup springs 25 acts on the blade 11, an appropriate positioning of the bar-shaped wedge 34 is provided on the basis of the thickness of the plate, the width of the bent edge that is to be obtained, and the surface characteristics of the plate itself and its possible coating. As already stated, the "end of travel" for the counterclockwise angular displacement of the blade 11 is prefixed by such a positioning of the bar-shaped wedge 34.

Successively, after having restored the oil to a prefixed pressure in seats 26, a pressure that clearly overcomes the opposition of all the cup springs 25, an appropriate positioning of the wedge 19 is effected, primarily as a function of the bending angle desired. At this point the press is ready to effect the desired bend upward. For this purpose, one proceeds in accordance with the following operating sequence:

previous discharge of the oil from all the cylindrical seats 26 and by action of the cup springs 25, the blade 11 is displaced angularly to the "end of travel" established by the prefixed position of the wedge 34. In this angular position of the blade 11 its active portion 11*a* is withdrawn with regard to the corner 3*a* of the counterblade 3 in a prefixed amount that also depends on the dimensional characteristics of the entire bending group. It should be noted that the abrupt stop of the blade 11 in the end of counterclockwise travel position involves only the positive stops 35 which, due to their advanced position with respect to the cylinders 27, prevent the lattter from being damaged in any way;

raising of the cutter block carriage 6. During this raising when the active portion 11*a* of the blade 11 enters into contact with the plate 12, a prebending action takes place on this plate, with the bending angle of value correlated to the distance of withdrawal of the said active portion 11*a* with regard to the corner 3*a* of the counterblade;

when the raising of the cutter block carriage 6 is completed, the oil is returned to a pre-established pressure in all the seats 26, such that the bending blade 11 is angularly shifted in a clockwise direction up to the end of travel established by the position of the bar-shaped wedge 9. As a result of this angular displacement, the bending of the edge of plate 12 is completed.

The principal advantages achieved with a forming press equipped with a bending blade 11 of the type described above (oscillating blade), by means of which the bending is effected in two successive phases, a prebending phase and a bending completion phase, are basically as follows:

the possibility of bending plates with treated surfaces, e.g., satinized, prepainted, stainless steel plates, and the like, with an avoidance of the risk of altering in any manner the consistency and surface appearance of the plate. Consequently, the need for finishing operations on the bent plate is eliminated;

the possibility of making bends with re-entrant bending angles over a broad range of values beyond the conventional 90°.

The preceding description was given with reference to the lower bending blade 11, but it is understood that the upper bending blade 10 can also be connected to the cutter block 6 in a manner quite similar to that described, when this should be required by the nature of the operation.

What is claimed is:

1. A forming press comprising a support structure having a C-shaped cross section with horizontal arms, a fixed lower counterblade, a blank holder upper counterblade, movable in the vertical direction, said counterblades being supported and extending longitudinally with regard to said support structure, a cutter block carriage movably guided in the vertical direction between the arms of said support structure, an upper bending blade and a lower bending blade mounted on said cutter carriage and having respective active parts cooperating with said counterblades for the downward and upward bending, respectively, of the edge of a plate firmly held by the counterblades themselves, and including the improvement in that at least one bending blade is longitudinally and rotatably mounted on a horizontal pivot supported by said cutter block carriage and extending longitudinally thereto, thrust elements being provided for angularly displacing said bending blade around said pivot toward and away from the respective counterblade, as well as adjustable positive stop elements between said cutter block carriage and said bending blade for limiting the amplitude of angular displacement of the blade in both directions.

2. A forming press according to claim 1, in which said positive stop elements comprise two bar-shaped wedges, mounted on said at least one bending blade, with respect to which they extend longitudinally and are adjustable, as well as fixed stops carried by said cutter block carriage and adapted to work together with said bar-shaped wedges.

* * * * *

UNITED STATES PATENT AND TRADEMARK OFFICE

CERTIFICATE OF CORRECTION

PATENT NO. : 4,385,513
DATED : May 31, 1983
INVENTOR(S) : Guido Salvagnini

It is certified that error appears in the above-identified patent and that said Letters Patent are hereby corrected as shown below:

Item (30) on title page should read:

-- Foreign Application Priority Data

August 2, 1979 (IT) . . . . . 24895 A/79 --

Signed and Sealed this

*Twenty-eighth* Day of *May 1985*

[SEAL]

*Attest:*

DONALD J. QUIGG

*Attesting Officer* *Acting Commissioner of Patents and Trademarks*